US008622272B2

(12) United States Patent
Hertlein et al.

(10) Patent No.: US 8,622,272 B2
(45) Date of Patent: Jan. 7, 2014

(54) SETTING TOOL

(75) Inventors: Peter Hertlein, Gams (CH); Stefan Petkov, Flums (CH); Mario Zahner, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 605 days.

(21) Appl. No.: 12/454,949

(22) Filed: May 26, 2009

(65) Prior Publication Data

US 2009/0294506 A1 Dec. 3, 2009

Related U.S. Application Data

(63) Continuation-in-part of application No. 11/207,834, filed on Aug. 19, 2005, now abandoned.

(30) Foreign Application Priority Data

Aug. 25, 2004 (DE) ..... 10 2004 041 079

(51) Int. Cl.
*B25C 1/08* (2006.01)

(52) U.S. Cl.
USPC ..... 227/10; 227/9; 227/11; 123/46 SC

(58) Field of Classification Search
USPC ..... 227/8, 9, 10, 11; 123/46 SC; 92/255, 92/258, 249
See application file for complete search history.

(56) References Cited

U.S. PATENT DOCUMENTS

| | | | | |
|---|---|---|---|---|
| 1,499,964 | A * | 7/1924 | Bell | 403/39 |
| 1,811,737 | A * | 6/1931 | Van Bezel | 403/255 |
| 3,219,248 | A | 11/1965 | Krewson | |
| 3,615,049 | A | 10/1971 | Obergfell | |
| 3,730,414 | A | 5/1973 | Becht | |
| 3,994,604 | A * | 11/1976 | Visser | 403/15 |
| 4,782,740 | A * | 11/1988 | Fagin et al. | 92/255 |
| 4,815,360 | A * | 3/1989 | Winterle | 92/255 |
| 5,713,313 | A * | 2/1998 | Berry | 123/46 SC |
| 5,860,580 | A | 1/1999 | Velan | |
| 6,585,142 | B1 * | 7/2003 | Chen | 227/130 |

FOREIGN PATENT DOCUMENTS

| | | | |
|---|---|---|---|
| AT | 230816 | | 4/1963 |
| FR | 2855444 | A1 * | 12/2004 |
| GB | 1172224 | | 11/1969 |
| GM | 78 18 775 | | 10/1978 |

* cited by examiner

*Primary Examiner* — Alexandra Elve
*Assistant Examiner* — Nathaniel Chukwurah
(74) *Attorney, Agent, or Firm* — Abelman, Frayne & Schwab

(57) ABSTRACT

A setting tool for driving fastening element in constructional components includes a setting mechanism having a combustion chamber (111) for generating expanding gases, a piston guide (117) adjoining the combustion chamber (111), a bolt guide (116) adjoining the piston guide (117) in the setting direction (140), and a drive piston (10) displaceable in the piston guide (117). The piston includes a piston head (11) and a piston body (12) connectable along an interface (13) with the piston head (11), the piston head (11) and the piston body (12) having, respectively, in an interface region, at least one stop surface (14) and at least one counter-stop surface (15) formed by surfaces defining essentially complementary tapering regions.

6 Claims, 2 Drawing Sheets

SETTING TOOL

RELATED APPLICATIONS

This application is a continuation-in-part of application Ser. No. 11/207,834 filed Aug. 19, 2005 now abandoned.

BACKGROUND OF THE INVENTION

1. Field of the Invention

The present invention relates to a setting tool for driving fastening elements in constructional components and driven by expanding gases and including a housing, and a setting mechanism located in the housing for driving the fastening element in a constructional component and including a combustion chamber, a piston guide adjoining the combustion chamber, a bolt guide for the fastening element and adjoining the piston guide in a setting direction, and a drive piston displaceable in the piston guide for driving the fastening element received in the bolt guide and driven by expanding gases generated in the combustion chamber. The drive piston has a piston head and a piston body connectable with the piston head along an interface, with the piston head and the piston body having, respectively, in an interface region, at least one stop surface and at least one counter-stop surface.

2. Description of the Prior Art

In the setting tools driven by expanding gases of the type discussed above, the piston head defines a piston area.

In setting tools with a comparatively small drive pressure of the expanding gases, the piston area should be significantly increased in order to provide a sufficiently large driving force. In order to prevent the increase of weight by the same amount, the piston body and the piston plate or head are formed as separate parts of different materials and which are then assembled. The piston body is formed, preferably, of a high-strength material because it directly contacts the set-in fastening element and should transmit, at a small diameter, which is substantially smaller than the head diameter, large forces.

U.S. Pat. No. 5,860,580 discloses a setting tool of the type described above and having a two-part piston in which a threaded connection provides for a fixed connection of the piston head with the piston body. The centering of the piston head with the piston body is carried out by the thread, whereas the transverse alignment of the piston head with the piston body is carried out by opposite flat or planar surfaces of the piston head and the piston body.

The drawbacks of such a piston consist in that the thread adversely influences the orthogonality between the piston head and the piston body because it is subjected to distortion upon hardening of the piston body by heat treatment. The orthogonality between the piston head and the piston body is necessary for retaining the piston in a proper setting position. The manufacturing of such piston is very expensive.

Accordingly, an object of the invention to provide a setting tool driven by expanding gases in which the orthogonality between the piston body and the piston head is insured.

Another object of the present invention is to provide a setting tool with which the manufacturing of the drive piston and, thus, of the setting tool is cost-effective.

SUMMARY OF THE INVENTION

These and other objects of the present invention, which will become apparent hereinafter, are achieved by providing in a setting tool of the type discussed above in which the at least one stop surface and the at least one counter-stop surface of the drive piston are formed by surfaces defining essentially complementary tapering regions that interface and provide orthogonal alignment of the piston body with the piston head.

Complementary tapering regions of the stop and the counter-stop surfaces insure a precise alignment of the piston body with the piston head which, in turn, insures their precise orthogonality. Further, the piston body and the piston head are easy to produce.

A secondary adjustment or even bending of the drive piston into a correct position during assembly of the setting tool is not any more necessary.

It is beneficial when the complementary tapering regions are formed as cone-shaped regions. The cone-shaped insure a backlash-free connection.

Advantageously, the stop surface, which is provided on the piston head, is formed as an inner cone, and the counter-stop surface, which is provided on the piston body, is formed as a substantially complementary outer cone. Thereby, a geometry, which is easy to produce, is obtained.

Advantageously, the stop surface and the counter-stop surface are inclined to a surface extending parallel to the piston head at an angle $\alpha$ from 10° to 80°.

According to another advantageous embodiment, the complementary tapering regions are formed as spherical regions. The spherical regions likewise insure a backlash-free connection.

Advantageously, the stop surface, which is provided on the piston head is formed as an inner sphere, and the counter-stop surface, which is provided on the piston body, is formed as a substantially complementary outer sphere. Thereby, a geometry, which is likewise easy to produce, is obtained.

It is advantageous when the interface has thread connection elements. The thread connection elements insure that a fixed connection can be easily obtained, which provides for alignment of the piston body when the piston head and the piston body are screwed together.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when ready with reference to the accompanying drawings.

DETAILED DESCRIPTION OF THE PREFERRED EMBODIMENTS

Figure 1:
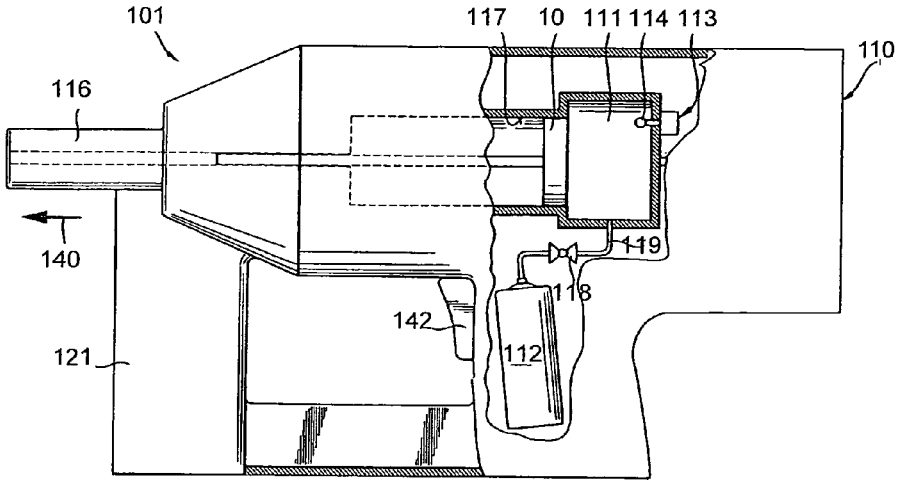
FIG. 1 a schematic partially cross-sectioned view of a setting tool according to the present invention.

A setting tool according to the present invention, which is shown in FIG. 1 and is driven with a fuel gas or with a vaporized liquid fuel. The setting tool 101 includes a housing 110 and a setting mechanism located in the housing 110. The setting mechanism drives a fastening element such as, e.g., a nail, a bolt, or the like in the constructional component. The setting mechanism includes, among others, a combustion chamber 111, a piston guide 117 adjoining the combustion chamber 111, and a drive piston 10 displaceably supported in the piston guide 117, and bolt guide 116 for a fastening element. The fastening element is driven into a constructional component by an end of the drive piston 10 facing in the setting direction 140. The bolt guide 116 adjoins the piston guide 117 at its end facing in the direction opposite to the setting direction. Fastening elements are stored, e.g., in a magazine 121 secured to the setting tool.

Figure 2:
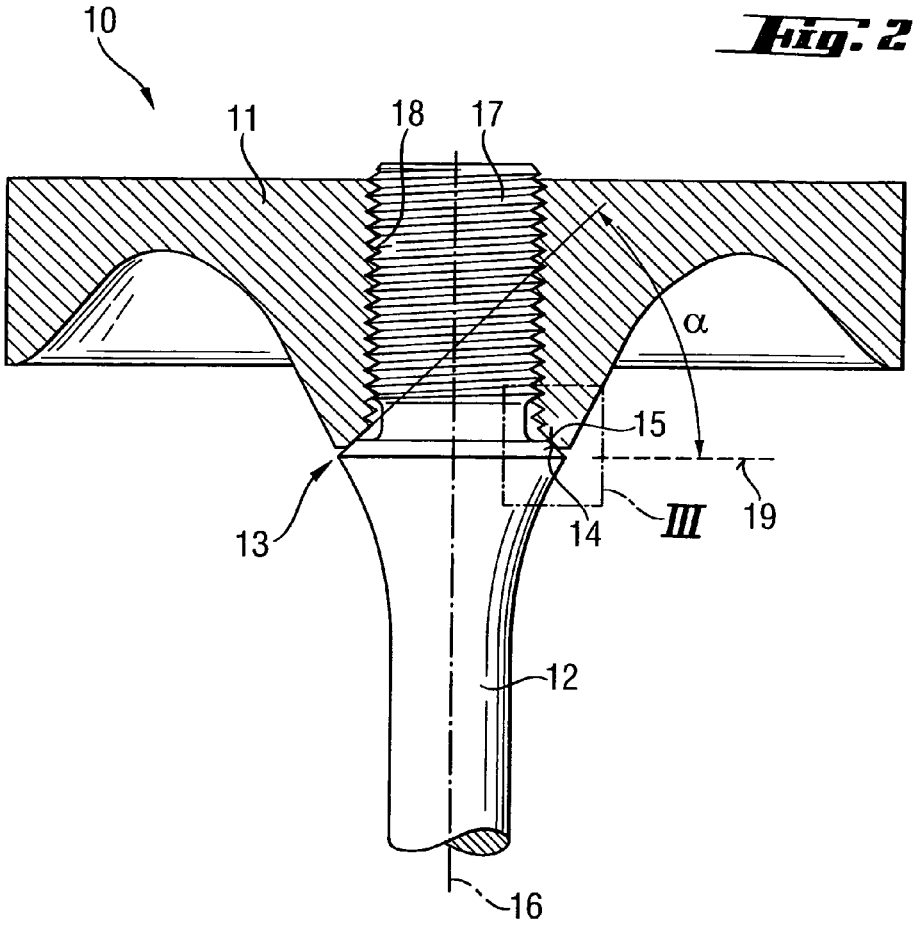
FIG. 2 a longitudinal cross-sectional view of a piston used in the setting tool shown in FIG. 1.

The drive piston 10, which is shown in FIG. 2, is formed of two parts and has a plate-shaped piston head 11, which extends in a plane 19 transverse to the piston axis 16, and an elongate, extending in the direction of the piston axis 16, piston body 12. The piston head 11 and the piston body 12 are connected with each other along an interface 13. To this end, the interface 13 is provided with thread means consisting of a threaded journal 17 provided on the piston body 12, and a threaded bore 18 formed in the piston head 11. In the piston head 11, there is provided a stop surface 14 that is formed as an inner cone surrounding the mouth of the threaded bore 18. A counter-stop surface 15, which surrounds a shoulder section of the threaded journal 17, abuts the stop surface 14. The counter-stop surface 15 is formed as an outer cone substantially complementary to the inner cone that forms the stop surface 14. The stop surface 14 and the counter-stop surface 15 extend, respectively, in a plane extending parallel to the plane 19. The stop surface 14 and/or the counter-stop surface 15 are inclined at an angle $\alpha$ between 10° and 80° relative to the plane 19 extending parallel to the piston head 11.

During the assembly of the piston 10, the alignment of the piston body 12 relative to the piston head 11 takes place over the conical stop surface 14 and the complementary thereto, conical counter-stop surface 15, without a need in any further adjustment. It should be understood that both the stop surface 14 and the counter-stop surface 15 can be formed as interrupted surfaces.

Figure 3:
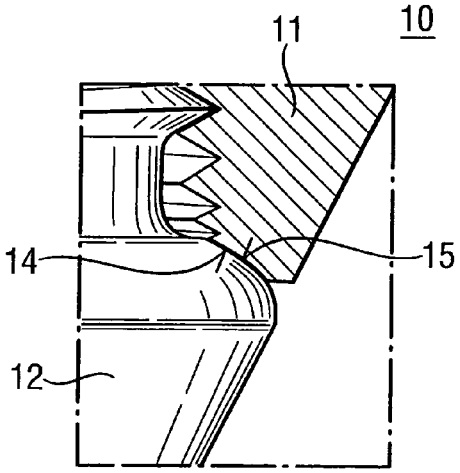
FIG. 3 a cross-sectional view of a section of a piston according to another embodiment and corresponding to cut-out III in FIG. 2.

FIG. 3 shows another embodiment of a piston according to the present invention. The piston 10, which is shown in FIG. 3, differs from the piston 10 shown in FIG. 2 only in that the stop surface 14 and the counter-stop surface 15 are formed as spherical annular surfaces. Here likewise, during the assembly of the piston 10, the alignment of the piston body 12 relative to the piston head 11 takes place over the spherical stop surface 4 and, the complementary thereto, spherical counter-stop surface 15, without a need in any further adjustment.

In the combustion chamber 111, there is provided ignition means. As the ignition means, e.g., a spark plug 114 can be used, which ignites an oxidation medium-fuel mixture fed into the combustion chamber 111. The fuel may be fed in the combustion chamber 111 from a fuel tank 112 or another fuel source through a conduit 119. A valve 118, e.g., a mechanical or electronic metering valve, is arranged in the fuel conduit 119. With the valve 118, which is controlled by mechanical or electronic control means (not shown), an amount of fuel fed into the combustion chamber 111 can be controlled. In addition, pressure sensing means (not shown) such as, e.g., a pressure sensor, can be arranged in the combustion chamber 111. With a pressure sensor, the oxidation medium-fuel mixture can be automatically ignited when the pressure in the combustion chamber 111 reaches a predetermined level. The automatic ignition of the oxidation means-fuel mixture can be effected with evaluating electronics which is connected with the pressure sensor and the ignition device 113 and which evaluates the pressure pulse generated by the pressure sensor and compares it with a set valve. In the transition region between the combustion chamber 111 and the piston guide 117, there can be provided magnet means (not shown). The magnet means can be used for retaining the drive piston 10 with a predetermined holding force in its initial position at an end of the piston guide 117 adjacent to the combustion chamber 111.

The setting tool 101 is actuated, upon the bolt guide 116 having been pressed against a constructional component or another object, with a trigger switch 142 provided on the setting tool 101. It should be noted that instead of the oxidation medium, the entire oxidation medium-fuel mixture can be pre-compressed by the compression device and be fed, in its compressed state, into the combustion chamber 111.

It should also be pointed out that the oxidation means or the oxidation means-fuel mixture can be pre-compressed directly in the combustion chamber 111. In this case, a storage reservoir can be eliminated.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to disclosed embodiments or details thereof, and the present invention includes all variations and/or alternative embodiments within the spirit and scope of the present invention as defined by the appended claims.

What is claimed is:

1. A setting tool for driving fastening elements in constructional components and driven by expanding gases, the setting tool comprising a housing (110); and a setting mechanism located in the housing (110) for driving the fastening element in a constructional component, the setting mechanism including a combustion chamber (111), a piston guide (117) adjoining the combustion chamber (111), a bolt guide (116) for fastening elements and adjoining the piston guide (117) in a setting direction (140), and a drive piston (10) displaceable in the piston guide (117) for driving the fastening element received in the bolt guide and driven by expanding gases generated in the combustion chamber (111), the drive piston (10) having a piston head (11), and a piston body (12) connectable with the piston head (1) along an interface (13), the piston head (11) and the piston body (12) having, respectively, in an interface region, at least one stop surface (14) and at least one counter-stop surface (15), the stop surface (14) and the counter-stop surface (15) being formed by surfaces defining essentially complementary tapering regions that interface and provide orthogonal alignment of the piston body (12) with the piston head (11), wherein the stop surface (14) and the counter-stop surface (15) are at least partially offset relative to each other in a radial direction.

2. A setting tool according to claim 1, wherein the complementary tapering regions are cone-shaped.

3. A setting tool according to claim 2, wherein the stop surface (14), which is provided on the piston head (11), is formed as an inner cone, and the counter-stop surface (15), which is provided on the piston body (12), is formed as a substantially complementary outer cone.

4. A setting tool according to claim 1, wherein the stop surface (14) and the counter-stop surface (15) are inclined to a surface (19) extending parallel to the piston head (11) at an angle ($\alpha$) from 10° to 80°.

5. A setting tool according to claim 1, wherein the interface (13) comprises a hollow space provided between an end surface of the piston head (11) and the stop surface (14).

6. A setting tool according to claim 1, wherein the essentially complementary tapering regions are formed by surfaces defining essentially complimentary spherical tapering regions.

* * * * *